United States Patent [19]

Ohrberg

[11] 4,261,250

[45] Apr. 14, 1981

[54] SLIDE SHOE ARRANGEMENT, PARTICULARLY FOR AXIAL AND RADIAL PISTON MACHINES

[75] Inventor: Carl V. Øhrberg, Nordborg, Denmark

[73] Assignee: Danfoss A/S, Nordborg, Denmark

[21] Appl. No.: 40,317

[22] Filed: May 18, 1979

Related U.S. Application Data

[63] Continuation of Ser. No. 697,615, Jun. 18, 1976, abandoned.

[30] Foreign Application Priority Data

Jul. 2, 1975 [DE] Fed. Rep. of Germany ..... 2529473

[51] Int. Cl.[3] ..... F01B 13/06

[52] U.S. Cl. ..... 91/491

[58] Field of Search ..... 91/488, 499, 472

[56] References Cited

U.S. PATENT DOCUMENTS

| | | | |
|---|---|---|---|
| 2,721,519 | 10/1955 | Henrichson | 91/472 |
| 3,521,532 | 7/1970 | Espig et al. | 91/499 |
| 3,650,180 | 3/1972 | Gantschnigg | 91/488 |
| 3,793,923 | 2/1974 | Smith | 91/488 |
| 3,863,997 | 2/1975 | Davis | 91/488 |
| 3,933,082 | 1/1976 | Moley | 91/499 |

*Primary Examiner*—William L. Freeh

*Attorney, Agent, or Firm*—Wayne B. Easton

[57] ABSTRACT

The invention relates to the slide shoe arrangement of a radial piston type of machine. This type of machine has a housing with a rotatable shaft and a piston carrier mounted on the shaft. Pistons in the carrier have reciprocal and radial movement relative to the carrier and shoes attached to the pistons have sliding engagement with an annularly shaped, eccentrically adjustable, track which surrounds the carrier. The track has a spherical surface portion with a predetermined radius R1. The shoes have spherically shaped surface portions of radius R2 which engage the track, radii R2 being larger than radius R 2 to form tapered gap chambers between the spherical shoe surfaces and the spherical track surface. The shoe portions may have annularly shaped flanges contacting the track surface through the spherical shoe surfaces. The flanges are resiliently connected to the shoe portions. A modification involves providing passages in the shoe portions which connect the gap chambers with ball and socket connections between the pistons and the shoes.

3 Claims, 6 Drawing Figures

FIG. 4
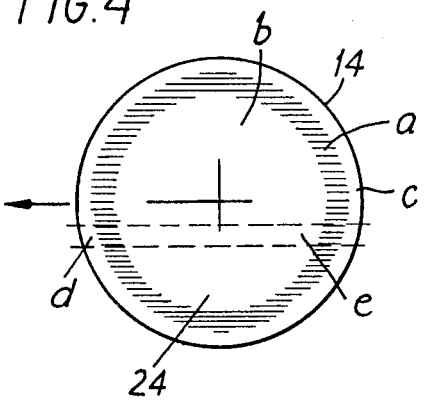
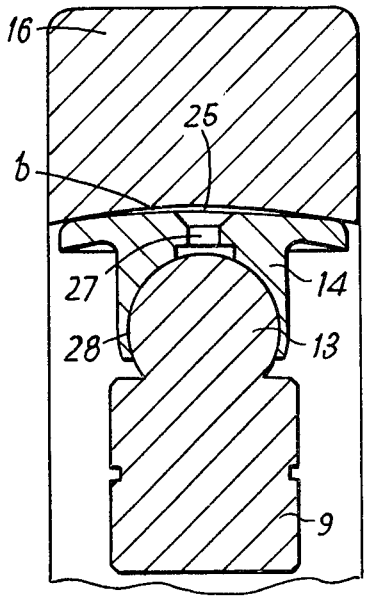
FIG. 5
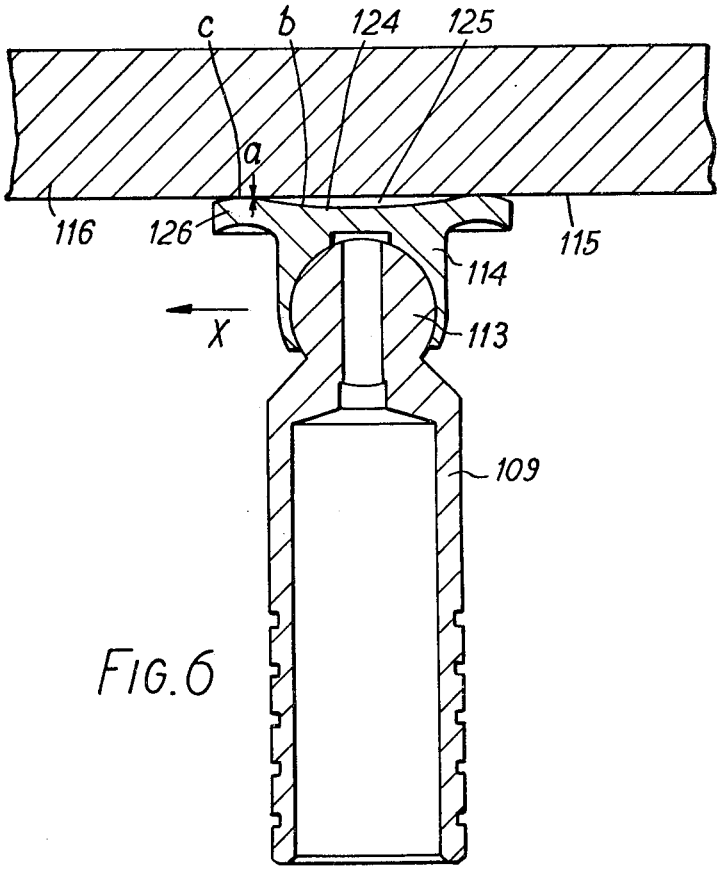
FIG. 6

SLIDE SHOE ARRANGEMENT, PARTICULARLY FOR AXIAL AND RADIAL PISTON MACHINES

This is a continuation application of application Ser. No. 697,615 filed June 18, 1976 now abandoned.

The invention relates to a slide shoe arrangement in which the sliding base of the slide shoe is movable on a slide track and defines therewith a gap containing a film of lubricant that covers the slide track, particularly for axial and radial piston machines in which the slide shoe is connected to the piston by a pivot.

For these and other applications in which the slide shoe is moved over the slide track at a constant speed, a hydrodynamic pressure builds up under the sliding base as a function of the relative speed, the thickness of the lubricating film, the viscosity of the lubricant and the like. This hydrodynamic pressure prevents the slide shoe from coming into direct contact with the slide track. The sliding base can have a shape corresponding to that of the slide track so that there will be a substantially constant width of gap. The gap can, however, also be wedge-shaped or stepped in order to increase the hydrodynamic pressure.

Since such constructions are inadequate for strongly loaded slide shoe arrangements, it has also already become known to provide a depression disposed in the middle of the slide shoe and circumferentially bounded by a sealing rim, lubricant being supplied to the depression under pressure so that the slide shoe is relieved partially by hydrostatic pressure and partially by hydrodynamic pressure.

The invention is based on the object of providing a slide shoe arrangement of the aforementioned kind in which the slide shoe can be subjected to comparatively high pressure loads without creating impermissible friction and without having to supply the lubricant under pressure. In particular, the slide shoe arrangement is to be suitable for applications in which the high pressure loads arrive pulsatingly.

This object is achieved according to the invention in that the width of the gap, starting from an annular region of narrowest gap width, gradually increases inwardly of the annulus at least in an annular section adjoining said annular region.

In this construction, a hydrodynamic pressure is built up at two positions behind one another in the direction of movement and this pressure holds the sliding base at an adequate spacing from the slide track, especially in the annular region of narrowest gap width. If, now, the slide shoe is more severely loaded, for example during the compression stroke of a rotary piston pump, the slide shoe is pressed slightly towards the slide track but there are several factors that counteract any tendency for the lubricating film to tear apart at this position. Firstly, the load is distributed over a larger annular region because the adjoining annular sections participate in pressure transmission in the region of the narrowest gap width. Secondly, the lubricant enclosed within the annular region of smallest gap width is subjected to a high pressure. This high pressure acts against the load on the slide shoe. In so far as lubricant attempts to escape outwardly through the annular region of narrowest gap width under this high pressure, it counteracts tearing of the lubricating film at this position. Particularly in the case of pulsating pressure loads, the arrangement can be such that the escape of the lubricant under the influence of the high pressure is ensured for the entire period of the higher pressure loads. The higher pressure loading on the lubricant increases its viscosity. This, again, helps to prevent seizing in the region of the narrowest gap width.

It is particularly favourable if the gap width, starting from the annular region of narrowest gap width, also gradually increases outwardly. This feature on the one hand helps to increase the region of narrowest gap width inwardly and outwardly under load. By reason of the wedge shape of the gap, a marked hydrodynamic pressure is also set up at this position. Last but not least, this ensures that sufficient lubricant is received by the slide track so as constantly to replenish the space within the annular region of narrowest gap width during the periods of low pressure loads.

In a preferred embodiment, provision is made for the fact that the annular region of narrowest gap width is bounded by a resilient portion of the slide shoe. More particularly, the resilient portion may be a flange surrounding the slide shoe. Under the influence of higher pressure loads, the elasticity permits deformation of the sliding base so that the annular region of narrowest gap width is particularly markedly increased.

A particularly simple way of forming the gap with different widths is provided if the slide track extends along a circle having a first radius and the sliding base has a comparatively larger radius in the peripheral direction of the track. In particular, the slide track may be formed by a spherical segment having a first radius and the sliding base may be formed by the segment of a sphere having a comparatively larger second radius.

Further, within the annular region of smallest gap width, the gap may communicate with the ball joint between the slide shoe and piston. The pulsatingly occurring pressure beneath the slide shoe will then also provide a pulsating pressure feed of lubricant to the ball joint.

The invention will now be described in more detail with reference to examples shown in the drawing. In the drawing:

FIG. 4 is a plan view of the sliding base of a slide shoe;

FIG. 5 is a cross-section through a modified embodiment of slide shoe arrangement, and FIG. 6 is a longitudinal section of a further embodiment of slide shoe arrangement.

Figure 1:
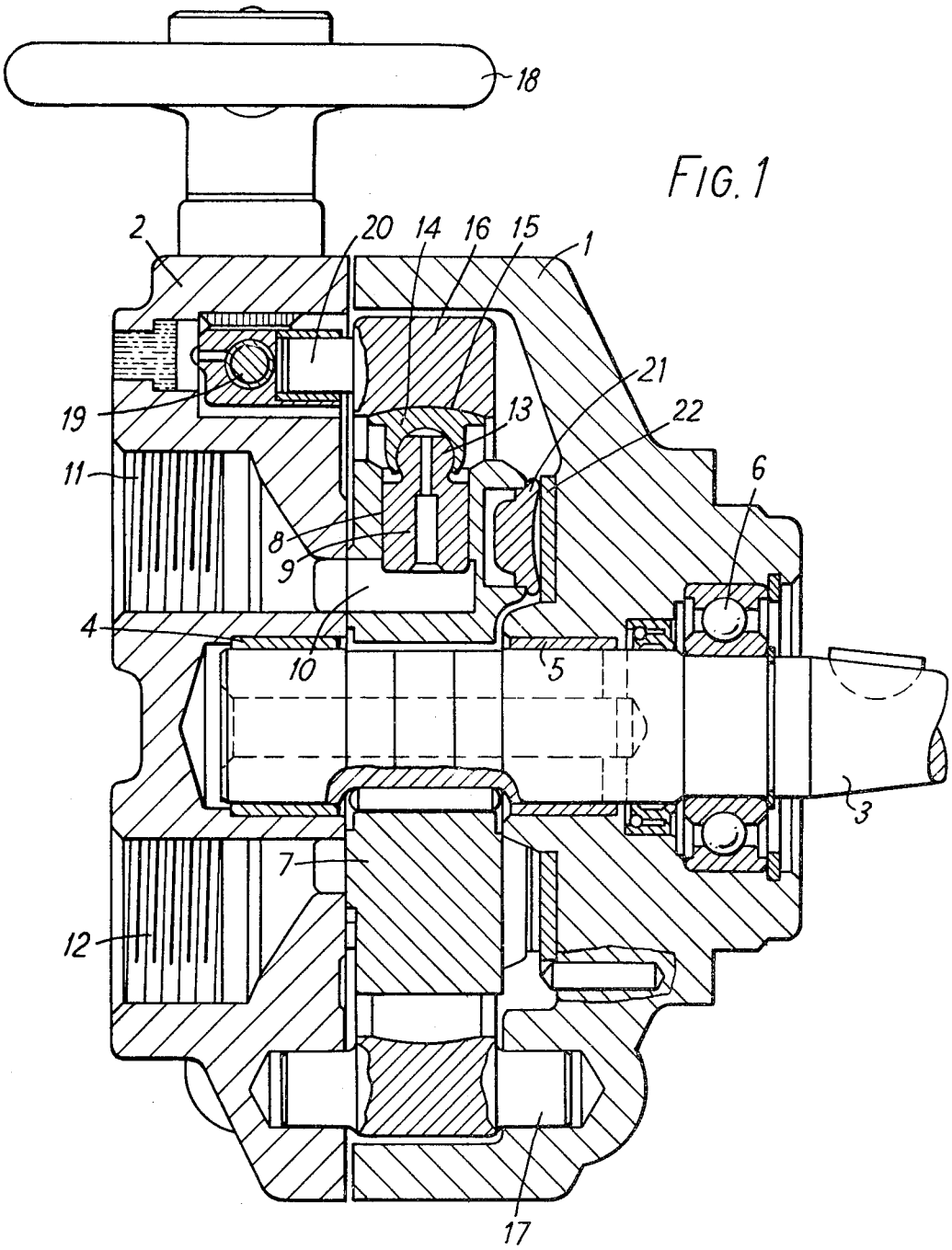
FIG. 1 is a longitudinal section through a radial piston machine.

The radial piston machine of FIG. 1 comprises a housing which is made of two parts 1 and 2 and in which a shaft 3 is mounted in bearings 4, 5 and 6. A piston carrier 7 fixed to rotate with the shaft has radial bores 8, each for receiving a piston 9, and communicates radially inwardly with a transverse passage 10 which is connected alternately to an inlet connection 11 and an outlet connection 12. The piston comprises a spherical head 13 on which a slide shoe 14 is mounted. The slide shoes co-operate with a track 15 of a track carrier 16. The track carrier is pivotable about a shaft 17 fixed with respect to the housing. Pivoting takes place with the aid of a handwheel 18 which acts on the track carrier 16 by way of worm gearing 19 and a pin 20. The piston carrier 7 also comprises further slide shoes 21 which co-operate with an annular track 22. The joint 13, 14 is provided with lubricant through a longitudinal passage 23.

Figure 2:
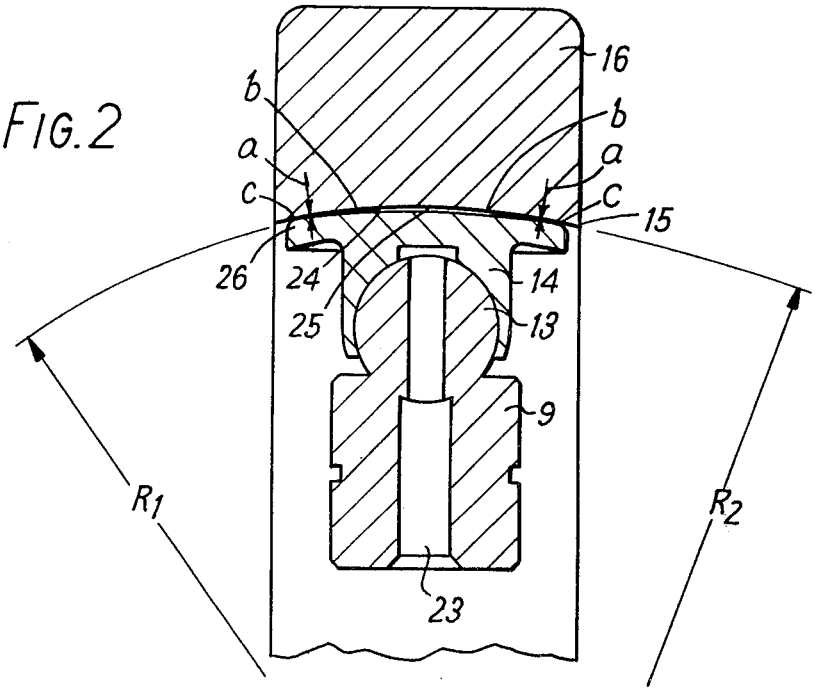
FIG. 2 is an enlarged cross-section of the slide shoe arrangement.
Figure 3:
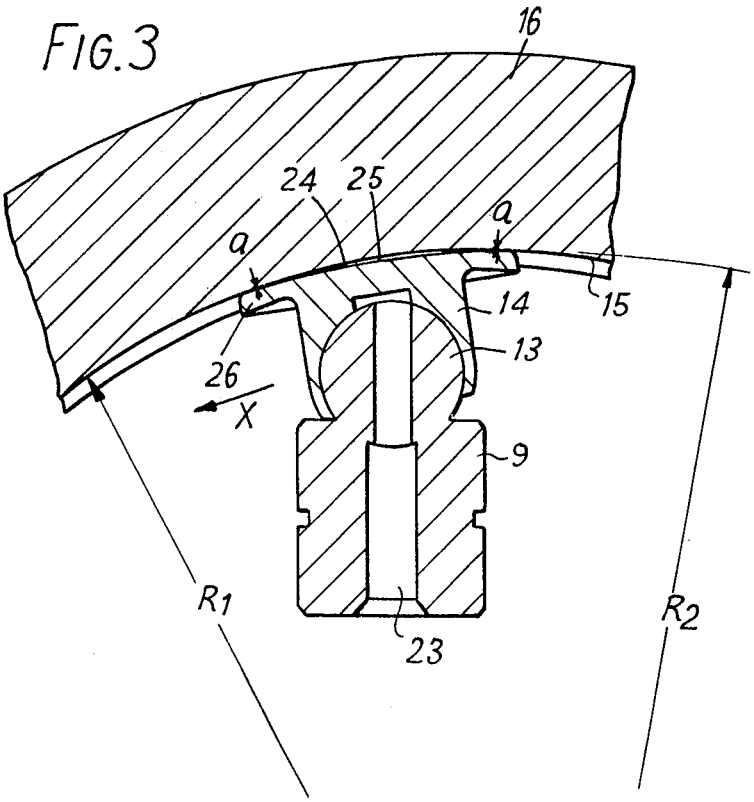
FIG. 3 is a longitudinal section of the slide shoe representation.

From FIGS. 2 and 3 it will be evident that the slide track 15 is formed by a spherical segment having a radius $R_1$. The slide shoe 14 has a sliding base 24 formed by the segment of a sphere with radius $R_2$. The radius $R_2$ is larger than the radius $R_1$. However, the drawing is very much exaggerated so as to show that a gap 25 is formed between the slide track 15 and sliding base 24, this gap having an annular region of narrowest gap width as indicated by the arrows a and becoming gradually larger in the region b towards the centre of the annulus as well as in the region c outwardly of the annulus. FIG. 4 again illustrates how the regions a of narrowest gap width and the regions b and c of increasing gap width are distributed along the sliding base 24. The slide shoe 14 has a peripheral flange 26 having a certain amount of elasticity. The region a is located beneath this elastic flange 26.

It is assumed that the slide shoe moves in the direction of the arrow X along the slide track 15. Lubricant disposed on the slide track will then also arrive between the slide shoe and slide track. If one considers a strip extending in the direction of movement as shown in broken lines in FIG. 4, two regions of wedge-shaped diverging cross-section are created within the gap 25, namely the regions d and e in which an increased hydrodynamic pressure is set up. The wedge aperture in the region d is preferably somewhat larger so as to receive as much lubricant, e.g. oil, from the slide track as possible. The wedge aperture in the region e is smaller. If, now, a higher pressure load is exerted on the slide shoe during the pressure stroke of the radial piston machine, the flange 26 first of all deforms so that the region a of narrowest gap width receives a larger area. If the slide shoe is simultaneously pressed somewhat closer to the slide track, the lubricant is subjected to a higher specific load in the region b. The lubricant partially penetrates outwardly through the region a of narrowest gap width so that an adequate lubricating film is available at that location during the high pressure load. Simultaneously, the lubricant is given a higher viscosity by reason of the high pressure, this likewise helping to prevent tearing of the lubricating film. As soon as the pressure load falls off, the region b of the gap 25 is rapidly replenished with lubricant from the slide track.

In the embodiment according to FIG. 5, a passage 27 leads between the piston 9 and slide shoe 14 from the gap 25 in the region b to the joint 13, 14. Consequently, during each higher pressure load at which the gap 25 is slightly reduced, lubricant is also led to the rea 28 between the ball 13 and slide shoe 14.

In the embodiment according to FIG. 6, the same integers as in the preceding figures are referenced by numbers increased by 100. Here, the track carrier 16 has a planar slide track 115 which may, for example, extend in an annulus. On a spherical head 113 a piston 109 carries a slide shoe 114. Between the sliding base 124 and the slide track 115 there is formed a gap 125 which again has the regions a, b and c described in FIG. 4. The slide shoe and the slide track may consist of materials that are conventional for this purpose. Steel which may have been given a surface treatment has proved particularly favourable for both parts.

The slide shoe 21 in FIG. 1 may have a construction similar to the slide shoe 114 in FIG. 6. Such a slide shoe will operate with little friction even if periodically higher pressures are created between the slide shoe and slide track 22 by reason of inaccuracies in alignment. In the illustrated embodiments the annular region a is circular. It could also be oval or rectangular.

I claim:

1. A hydroynamically lubricated radial piston machine comprising a housing, a shaft rotatably mounted in said housing, a piston carrier attached to and rotatable with said shaft, pistons in said carrier mounted for reciprocal and radial movement relative thereto, an annularly shaped track surrounding said carrier, said track having a spherically shaped surface having a radius R1, shoes pivotally attached to said pistons, each said shoe having a surface with a spherically shaped center portion of radius R2 larger than said radius R1, each said shoe surface having an annularly shaped contact portion forming the periphery of said center portion and having sliding engagement with said track surface, said shoe center portion forming with said track surface a circular tapered gap chamber to provide hydrodynamic lubrication for the trailing part of said contact portion, and a third portion of said shoe surface formed radially exteriorly of said contact portion and forming with said track surface a circular tapered gap recess which is divergent relative to said contact portion to provide hydrodynamic lubrication for the leading part of said contact portion and to feed lubricant to said tapered gap chamber, said gap recess being formed in each case by the normal unflexed configuration of each said shoe without flexure by operating pressures.

2. A hydrodynamically lubricated piston machine according to claim 1 wherein each said shoe has a body portion and a resiliently connected annular flange portion which is moveable with respect to said body portion, for each said shoe said shoe flange portion being cyclically movable relative to said shoe body portion responsive to normal cyclical compression strokes of said machine to cyclically compress and expand said tapered gap chamber to cyclically force lubricant from said chamber across said contact portion to enhance the lubricating film between each said shoe contact portion and said track surface during said compression strokes.

3. A hydrodynamically lubricated radial piston machine according to claim 1 or 2 wherein ball and socket connections are between said shoes and said pistons, and passage means in said shoes connecting the respective ones of said gap chambers with said ball and socket connections to provide lubrication thereof.

* * * * *